United States Patent [19]

Nunez et al.

[11] Patent Number: 4,654,079

[45] Date of Patent: Mar. 31, 1987

[54] PROCESS FOR IMPROVING THE EXTRACTION YIELD OF SILVER AND GOLD IN REFRACTORY ORES

[75] Inventors: Carlos Nunez; Antonio Roca; Fernando Espiell, all of Barcelona, Spain

[73] Assignee: Nunez, Roca, Espiell, Universidad de Barcelona, Barcelona, Spain

[21] Appl. No.: 708,394

[22] Filed: Mar. 5, 1985

[30] Foreign Application Priority Data

Mar. 13, 1984 [ES] Spain ..... 530.538

[51] Int. Cl.[4] ..... C22B 11/04

[52] U.S. Cl. ..... 75/118 R; 75/2; 75/101 R; 75/105; 423/27; 423/29; 423/30; 423/31; 423/37

[58] Field of Search ..... 75/105, 2, 118 R, 101 R; 423/27, 29, 30, 31, 37

[56] References Cited

U.S. PATENT DOCUMENTS

| | | | |
|---|---|---|---|
| 3,189,435 | 6/1965 | Lower | 423/29 |
| 3,429,694 | 2/1969 | Lower | 423/29 |
| 4,072,587 | 2/1978 | Heinen et al. | 423/37 |

*Primary Examiner*—John Doll
*Assistant Examiner*—Robert L. Stoll
*Attorney, Agent, or Firm*—Birch, Stewart, Kolasch & Birch

[57] ABSTRACT

A process for the extraction of silver and gold from refractory ore is disclosed. The process includes first grinding the refractory ore. This ground refractory ore is subsequently treated with an alkali solution of a stoichiometric excess amount of sulphide in relation to the amount of gold and silver contained in the refractory ore, to thus form a pulp containing a gold and silver sulfide. The pulp and alkaline solution ore are aerated to oxidize the excess sulfide to sulfate and then a mixture of the pulp and cyanide liquor are formed. Finally this mixture is aerated to obtain a final gold and silver product.

8 Claims, No Drawings

PROCESS FOR IMPROVING THE EXTRACTION YIELD OF SILVER AND GOLD IN REFRACTORY ORES

The present invention relates to the extraction of silver and gold, with high yields, from oxidized pyrite ores, stripping ores or Gossan ores, argentojarosite ores and particularly those from which silver and gold are obtained with low extraction yields by cyaniding or ores containing slightly soluble silver or refractory ores.

The current process for obtaining silver and gold from these ores consists of mining the mineral and preparing for crushing and grinding stages until a stage of 75% by weight with a particle size below 40 microns is reached. The ground ore is previously conditioned with lime, followed by leaching with a dilute sodium cyanide solution. Thereafter this pulp is subjected to a solid-liquid separation and the leaching liquors containing the silver and gold are cemented with a more electronegative metal such as zinc. The gold and silver powder is melted, and a gilded metal ingot or bullion is cast.

The present extraction yield with this process is only about 40% for silver and 85% for gold, that is the already leached or treated ore or gossan residue or gossan tailings as it is known, still holds 60% of the silver contained in the fresh or gossan headings.

The process according to the present invention allowing high percentages of silver and even to increase the percentage of gold to be extracted, is conducted as follows: the ore or the already treated ore tailings from which it is wanted to extract the residual silver still contained therein are contacted, as a stage prior to cyaniding, with an alkaline solution (NaOH, KOH or lime), of sodium sulphide at room temperature. There are several ways of contacting this alkaline sulphide solution with the ore in any degree of division, either in a reactor or in a thickener or by leaching in piles, etc.

Further to sodium sulphide, other soluble or slightly soluble sulphides such as potassium sulphide, calcium sulphide, ammonium sulphide or any other organic or inorganic soluble sulphide compatible with an alkaline solution or any chemical providing sulphide ($S^{2-}$) ions or hydrosulphide ($SH^-$) ions to the solution may be used as sulphurizing agents.

The silver, a large proportion of which appears to be as argentojarosite in these Gossan ores, is sensitive to the action of the sulphide so as to allow larger amounts to be extracted in the subsequent cyaniding process than those obtained without this prior sulphide treatment.

It is believed that the reaction occurring is as follows, the gold and silver bearing ore being designated by (M).

$$2M\text{—}Ag + S^{2-} \text{alkaline medium } 2M^- + Ag_2S$$

This silver sulphide would be formed by displacement, since it is much more insoluble than the silver compound in the mineral. After the prior sulphide treatment, the Gossan pulp is transferred to a conditioning tank in which the excess sodium sulphide is oxidized to sulphate in an alkaline medium by blowing currents of air through it. This sulphate does not interfere with the subsequent cyanide operation and therefore avoids additional cyanide consumption. This excess sulphide in the pulp may also be burned or oxidized with any cheap oxidant which subsequently does not interfere with the cyanides. Once the excess sulphide has been removed, the ore pulp is fed to the known cyaniding stage in which the silver sulphide formed is dissolved with the aid of air and the cyanide, etc.

Since the present invention represents an extra leaching step between the grinding and the cyaniding, stages in view of the layout of the existing plants, it may be easily incorporated into the established processes.

Since the cyaniding iquors may be recycled, at least partly, after the cementation, the exhausted alkali in the preparation of the sulphide solutions may also be recycled, at least to a certain extent with the consequent alkali saving.

In a similar way, the cyaniding may be replaced by a treatment with sodium chloride or calcium chloride lyes having a small amount of dissolved chlorine. The extraction yields are slightly higher than those attained by cyaniding.

To facilitate the complete description of the invention, the following examples are given which are in no way limitative but only explicative of the process described.

EXAMPLE I

One kilogram of gossan ore ground to particle sizes at least below 90 microns was taken as a base. A typical composition of this gossan was: 2.7 g gold per tonne and 50 g silver per tonne. 0.33 liters of a twice (2) molar solution in sodium hydroxide or 80 g of NaOH per liter also having 0.25 moles of sodium sulphide, as $Na_2S$ per liter or 20 g of sodium sulphide, as $Na_2S$ per liter were added to this kilogram of gossan. In this way the 0.33 liters added to the gossan contained 26.7 g of NaOH and 6.67 g of $Na_2S$ in solution at room temperature.

The gossan and the solution were contacted for about six (6) days without stirring. At the end of these six days, the pulp was diluted to 50% solids or a similar level since this aspect is not critical and was aerated until the excess sulphide was oxidized with the air current. Thereafter the process followed the normal steps of cyaniding in the current plants, that is, a few grams of sodium cyanide were added to this sulphurized pulp and the air was blown through for 24 hours as usual, but now the extraction yields obtained by using the prior leaching with sulphurized alkaline solutions were: Gold extraction yield, 96%. Silver extraction yield, 76%.

The gold and silver contents remaining in the gossan residues after treatment by the process described herein were: 0.1 g of gold per tonne of gossan tailings and 12 g of silver per tonne of gossan tailings, there having been recovered therefore 2.6 g gold and 38 g of silver per tonne of gossan treated.

EXAMPLE II

One kilogram of ground gossan ore having a richness of 2.1 gr of gold per tonne and 63 gr of silver per tonne was taken as a base. 0.66 liters of lime saturated water containing also 10 gr of sodium sulphide, as $Na_2S$ per liter were added to this kilogram. In this way the 0.66 liters added to the gossan contained 6.67 gr $Na_2S$ in solution at room temperature.

The solution and gossan were contacted for one day with moderate stirring (from 100 to 200 rpm). At the end of this day, the pulp was diluted to 50% solids and air was bubbled through it until the excess sulphide was oxidized. Thereafter the process followed the normal cyaniding channels. The gold extraction yield was 90% and the silver extraction yield was 64%.

Having sufficiently described the nature of the invention, as well as the way of reducing it to practice, it should be stated that the above arrangements are liable to modifications of detail so as not to depart from the spirit and scope of the present invention.

We claim:

1. A process for the extraction of silver and gold from refractory ores thereof, comprising:

grinding the refractory ore;

treating the refractory ore with an alkaline solution of a stoichiometric excess amount of sulphide in relation to the amount of gold and silver contained in the refractory ore to form a pulp containing a gold and silver sulphide;

aerating the pulp and alkaline solution to oxidize the excess sulphide to sulphate;

forming a mixture of the pulp with a cyanide liquor;

aerating the mixture to obtain a final gold and silver product.

2. The process according to claim 1, wherein the alkaline solution has a pH of from 7 to 14.

3. The process according to claim 1, wherein the alkaline solution contains a soluble sulfide selected from the group consisting of sodium sulphide, potassium sulphide, and calcium sulphide.

4. The process according to claim 1, wherein the refractory ore is treated with the alkaline solution at room temperature.

5. The process according to claim 1, wherein the refractory ore is treated with the alkaline solution for about one hour to about one week.

6. The process according to claim 2, wherein the refractory ore is a member selected from the group consisting of oxidized pyrite ores, gossan ores and argentojarosite ores.

7. The process according to claim 1, wherein the refractory ore has previously been treated with a cyanide solution.

8. The process according to claim 1, wherein the refractory ore is treated with the alkaline solution of a sulphide at the grinding stage.

* * * * *